US006439614B1

(12) United States Patent
Cowan

(10) Patent No.: US 6,439,614 B1
(45) Date of Patent: Aug. 27, 2002

(54) NESTED LEAFLET LABEL STRUCTURE

(76) Inventor: Randy G. Cowan, 600 E. 52nd St. North, Sioux Falls, SD (US) 57104

( * ) Notice: Subject to any disclaimer, the term of this patent is extended or adjusted under 35 U.S.C. 154(b) by 63 days.

(21) Appl. No.: 09/931,220

(22) Filed: Aug. 16, 2001

(51) Int. Cl.[7] ..... B42D 15/00

(52) U.S. Cl. ..... 283/81; 283/107; 283/101; 281/2; 281/5; 428/41.7

(58) Field of Search ..... 281/2, 5; 283/79, 283/80, 81, 101, 105, 107–111; 428/40.1, 41.7, 41.8, 42.1, 42.3, 42.2; 40/299, 630

(56) References Cited

U.S. PATENT DOCUMENTS

| | | | | |
|---|---|---|---|---|
| 4,991,878 A | | 2/1991 | Cowan et al. | |
| 5,021,273 A | | 6/1991 | Kobayashi | |
| D327,709 S | | 7/1992 | Hagen | |
| 5,324,559 A | | 6/1994 | Brombacher | |
| 5,403,636 A | * | 4/1995 | Crum | 283/81 X |
| 5,507,901 A | | 4/1996 | Limina et al. | |
| 5,587,222 A | | 12/1996 | Hoffmann | |
| 5,674,334 A | | 10/1997 | Instance | |
| 5,863,628 A | * | 1/1999 | Barry | 283/81 X |
| 5,866,219 A | * | 2/1999 | McClure et al. | 283/81 X |
| 5,951,054 A | * | 9/1999 | Hagen et al. | 283/81 |
| 6,027,780 A | | 2/2000 | Treleaven et al. | |
| 6,057,019 A | | 5/2000 | Barry | |

* cited by examiner

*Primary Examiner*—Willmon Fridie, Jr.
(74) *Attorney, Agent, or Firm*—Kaardal & Leonard, LLP; Jeffrey A. Proehl

(57) ABSTRACT

A nested leaflet label structure having an enhanced information carrying capacity. The nested leaflet label structure includes a base panel having a front face. A first leaflet is adjacent to the front face and comprises a first folded panel having a first fold extending substantially parallel to the first axis of the label structure. The first fold divides the first folded panel into a pair of first leaves each having inner and outer page faces. A second leaflet comprises a second folded panel having a second fold extending substantially parallel to the first axis of the label structure. The second fold divides the second folded panel into a pair of second leaves each having inner and outer page faces. A laminating layer overlies the base panel and the first leaflet. The second leaflet is nested in the first leaflet. An assembling adhesive adheres the second leaflet to the first leaflet.

10 Claims, 3 Drawing Sheets

NESTED LEAFLET LABEL STRUCTURE

BACKGROUND OF THE INVENTION

1. Field of the Invention

The present invention relates to multiple panel labels and more particularly pertains to a new nested leaflet label structure for providing a simplified label structure having a relatively large information carrying capacity.

2. Description of the Prior Art

Safety concerns and government regulations have led to an increasing need to place relatively large amounts of information about substances (such as chemicals) directly on the containers containing the substances. The need to incorporate the necessary information on the containers has led to the development of label assemblies that include additional printed sheets that have the ability to be moved away from the surface of the container.

Known label assemblies include "in-line" labels in which a single folded sheet forms two panels with four pages that are available for printing. A clear overlying film secures the single folded sheet to the front of a base label. The base label has a pressure sensitive adhesive on a side of the base label opposite the single folded panel. While the assembling of this type of label may be done on a single assembly pass, the amount of information that may be printed on the in-line label is limited to what can be fit on the four pages, and thus this type of label is not suitable for conveying large amounts of product information.

Another type of known label assembly includes a leaflet comprised of a single sheet that has multiple folds to form an accordion fold of multiple panels. One panel of the single sheet is adhered to the overlying film panel, and the remainder of the panels are tucked into a pocket formed between the base label and the overlying film. Opening the pocket permits the panels to be unfolded and viewed by the user. The leaflet type of label assembly permits greater amounts of information to be conveyed on the label, but since the single sheet may extend a significant distance from the point of attachment of the sheet to the base labels, the label is highly vulnerable to loss of some of the label if the label is not carefully refold and reinserted into the pocket formed between the overlying layer and the base label.

A variation of this label assembly incorporates a booklet in the pocket instead of the sheet with multiple folds. The booklet includes multiple folded sheets that are nested together and stapled or glued together to hold the folded sheets together. The stapling or gluing and trimming of the panels together often requires a separate operation from the printing and label assembly operations, and thus the booklet formation operation cannot be performed as a single label assembling operation. The additional, separate booklet printing and binding process typically requires additional space and expense.

SUMMARY OF THE INVENTION

In view of the foregoing disadvantages inherent in the known types of multiple panel labels now present in the prior art, the present invention provides a new nested leaflet label structure that satisfies the need for a simplified label structure having a relatively large information carrying capacity.

To attain this, the present invention generally comprises a base panel having a front face. A first leaflet is adjacent to the front face and comprises a first folded panel having a first fold extending substantially parallel to the first axis of the label structure. The first fold divides the first folded panel into a pair of first leaves each having inner and outer page faces. A second leaflet comprises a second folded panel having a second fold extending substantially parallel to the first axis of the label structure. The second fold divides the second folded panel into a pair of second leaves each having inner and outer page faces. A laminating layer overlies the base panel and the first leaflet. The second leaflet is nested in the first leaflet. An assembling adhesive adheres the second leaflet to the first leaflet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
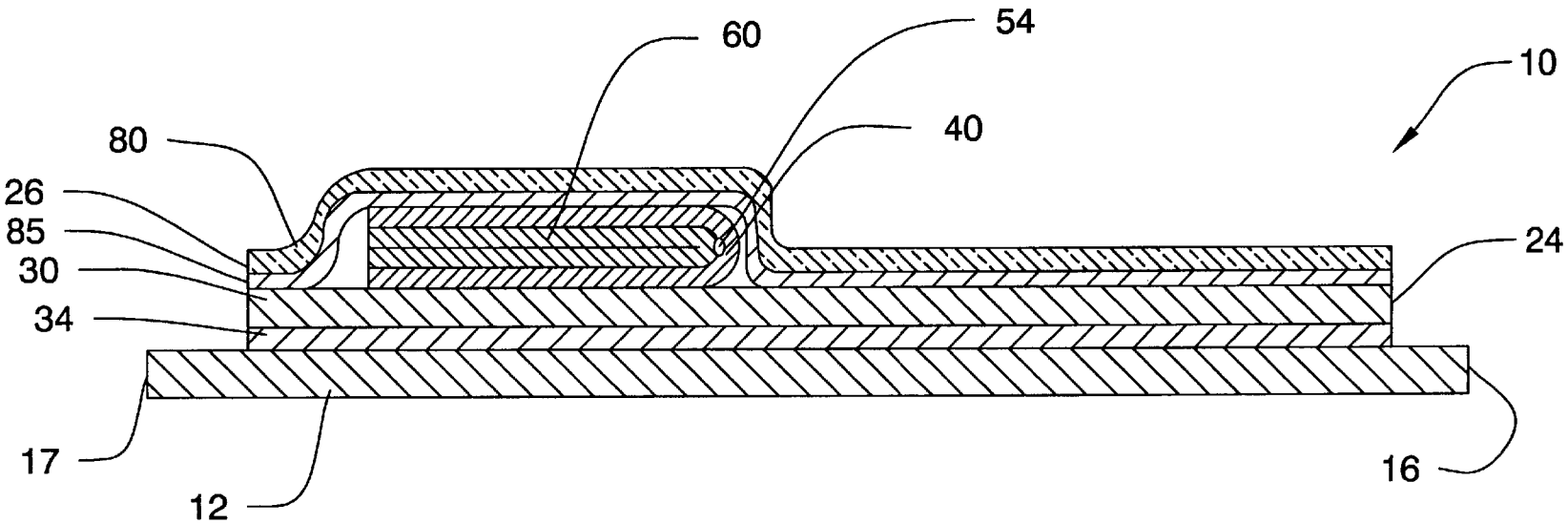
FIG. 1 is a schematic sectional view of a new nested leaflet label structure according to the present invention (in a closed condition).
Figure 2:
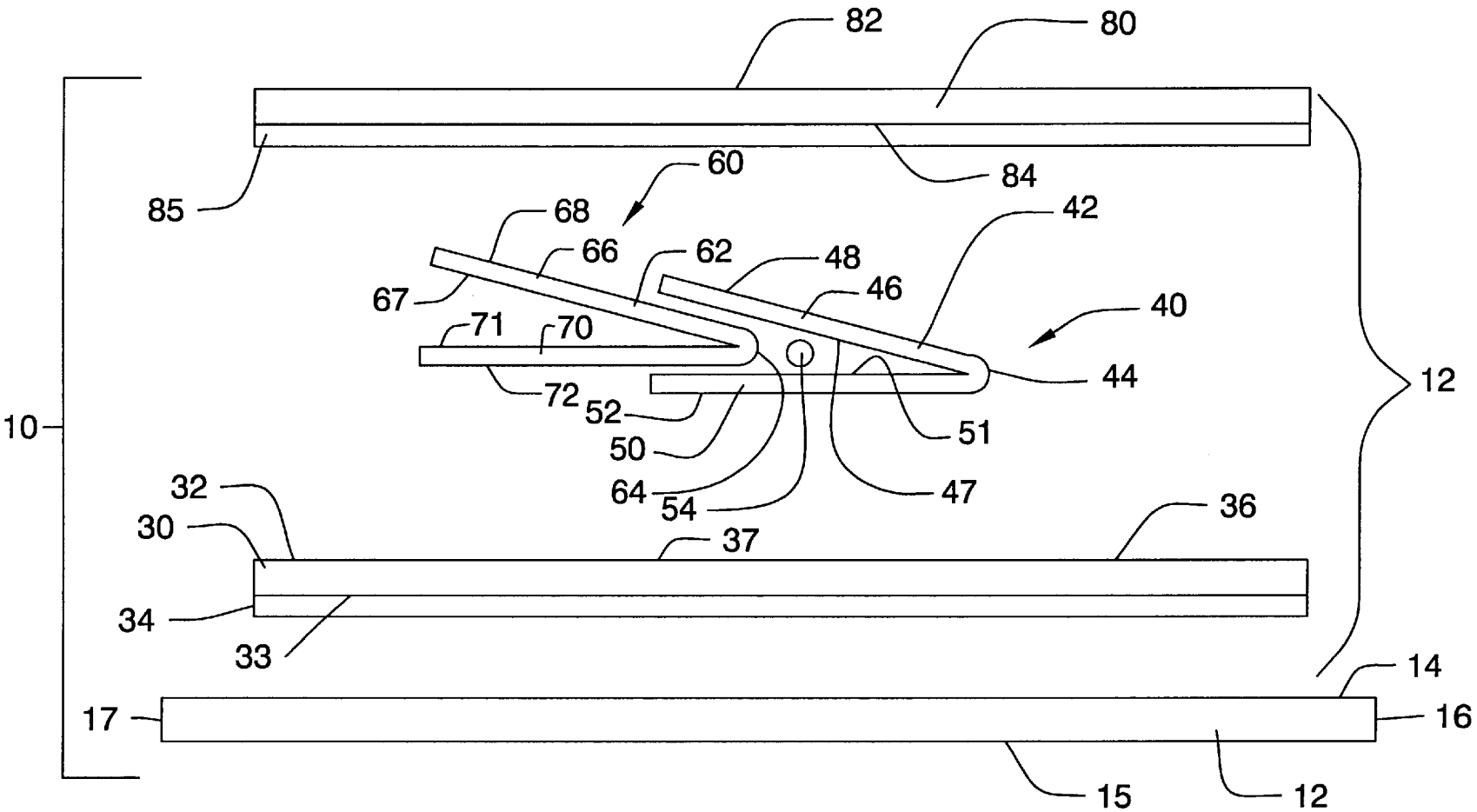
FIG. 2 is a schematic exploded side view of the label structure of the present invention.
Figure 3:
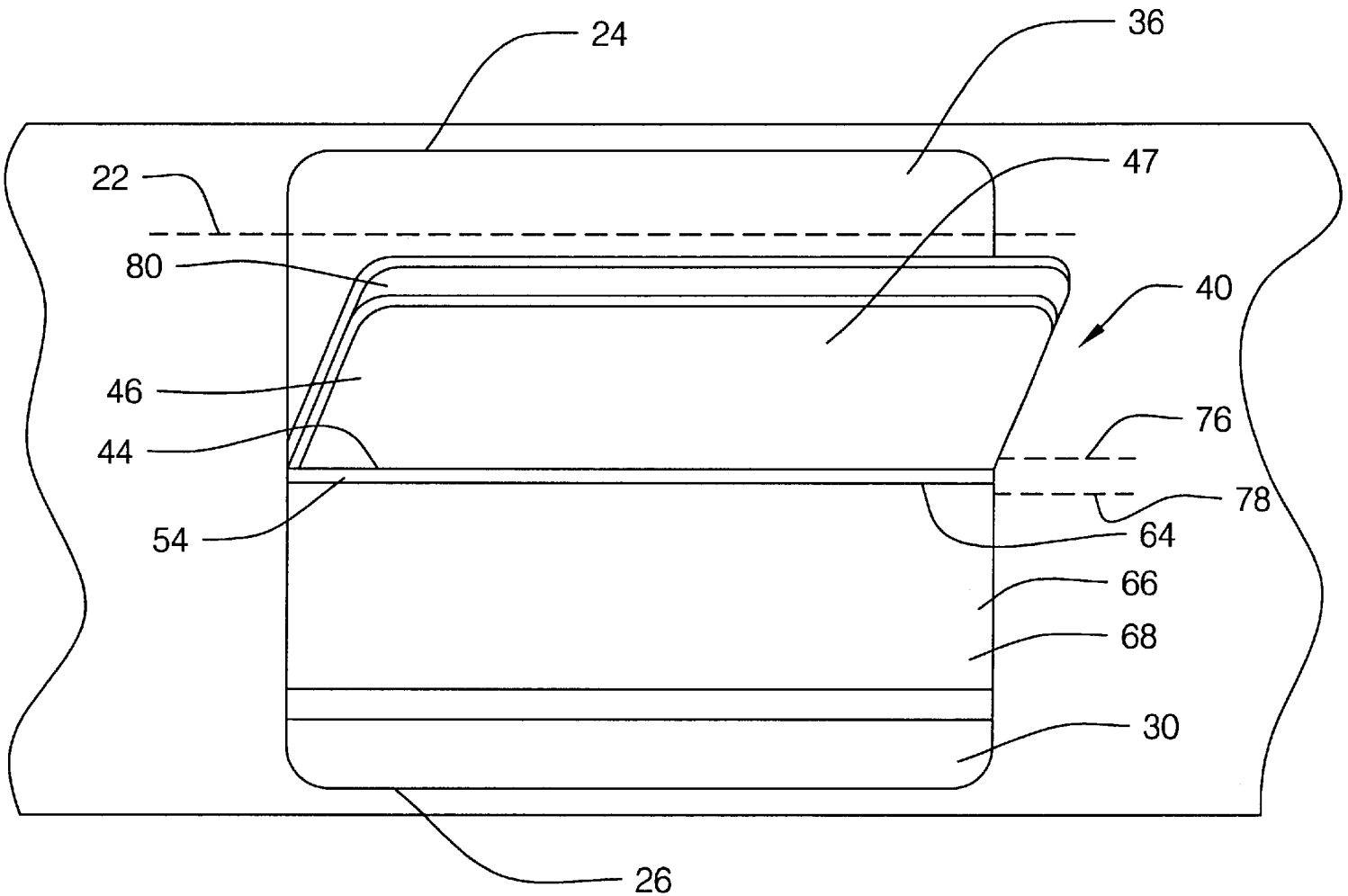
FIG. 3 is a schematic front view of the label structure with the first leaflet opened up to show a portion of the second leaflet of the present invention.

With reference now to the drawings, and in particular to FIGS. 1 through 3 thereof, a new nested leaflet label structure embodying the principles and concepts of the present invention and generally designated by the reference numeral 10 will be described.

As best illustrated in FIGS. 1 through 3, the nested leaflet label structure 20 of the invention may form a portion of a label system 10 which includes a liner 12 on which the label structure may be removably adhered. The liner 12 is provided for carrying at least one label structure after the label structure is formed and prior to application of the label structure to a surface, such as on a container. Optionally, the label structure (or components thereof) may be carried on the liner as the label structure is being formed or constructed. The liner 12 may comprise an elongate web of material that may be coiled about a spool with a plurality of the label structures applied thereon. The elongate liner 12 may have a longitudinal extent or axis that extends along a longitudinal extent of the liner. The liner 12 has front 14 and back 15 faces, and first 16 and second 17 side edge. The first 16 and second 17 side edges may extend substantially parallel to the longitudinal extent of the liner. The front face 14 of the liner preferably comprises a release surface that permits peeling of the label structure from the front face. Illustratively, a silicone composition may be applied to the front face 14 to form the release surface, and the liner may comprise a paper material. Other materials may also be suitable for forming the liner 12.

The label structure 20 may be removably applied to and carried on the liner 12 as a means of storing the label structure prior to application of the label structure to a surface, such as, for example, the outer surface of a container. The label structure generally has a first axis 22 or extent that extends substantially parallel to the longitudinal extent of the liner, and also the side edges 16, 17 of the liner. The label structure 20 has first 24 and second 26 sides that may extend substantially parallel to the first axis 22.

In one embodiment of the invention, the label structure 20 comprises an assembly of a base panel 30, a first leaflet 40, a second leaflet 60, and a laminating layer 80. The base panel 30 is provided for affixing to a surface, such as on a product or a product container. The base panel 30 has front 32 and back 33 faces. The back face 33 of the base panel 30 may have an adhesive 34 applied thereon for releasably affixing the base panel on the release surface of the liner, and subsequently on a surface. The adhesive 34 preferably comprises a pressure sensitive adhesive, although other types of adhesive may optionally be used. The base panel 30 may be substantially opaque such that indicia marked thereon are more easily readable on the front face 32. The front face 32 of the base panel 30 may have first 36 and second 37 areas. Indicia, such as alphanumeric characters and/or logos, may be marked on the first area of the front face of the base panel. Similarly, indicia 39 may be marked on the second area of the front face of the base panel.

The first leaflet 40 is positioned adjacent to the front face 32 of the base panel 30, and preferably is positioned against the front face of the base panel. The first leaflet 40 may comprise a first folded panel 42. The first folded panel 42 has a first fold 44, and the first fold may extend substantially parallel to the first axis 22 of the label structure. The first fold 44 divides the first folded panel 42 into a pair of first leaves 46, 50. Each of the first leaves 46, 50 has an inner page face 47, 51 and an outer page face 48, 52.

The inner page faces 47, 51 of the first leaves 46, 50 are oriented inwardly toward each other, and the outer page faces 48, 52 of the first leaves are oriented outwardly away from each other. The pair of first leaves 46, 50 includes a front first leaf 46 and a back first leaf 50. The outer page face 52 of the back first leaf 50 is oriented toward the front face 32 of the base panel 30, and may be positioned adjacent to the front face 32, and may cover a portion of the second area 37 of the front face. Each of the inner 47, 51 and outer 48, 52 page faces of the front first leaf 46 and the back first leaf 50 is adapted for permitting viewing of indicia marked thereon.

The second leaflet 60 may comprise a second folded panel 62. The second folded panel 62 has a second fold 64. The second fold 64 may extend substantially parallel to the first axis 22 of the label structure 20. The second fold 64 divides the second folded panel 62 into a pair of second leaves 66, 70. Each of the second leaves 66, 70 has an inner page face 67, 71 and an outer page face 68, 72.

The inner page faces 67, 71 of the second leaves 66, 70 are oriented inwardly toward each other and the outer page faces 67, 71 of the second leaves are oriented outwardly away from each other. The pair of second leaves includes a front second leaf 66 and a back second leaf 70. The outer page face 72 of the back second leaf 70 is oriented toward the outer page face 48 of the front first leaf 46 of the first leaflet 40. Each of the inner 67 and outer 68 page faces of the front second leaf 66 and the back second leaf 70 are adapted for permitting viewing of indicia marked thereon.

The first fold 44 in the first folded panel 42 defines a first fold axis 76 and the second fold 64 in the second folded panel 62 defines a second fold axis 78. The first fold axis 76 is typically oriented substantially parallel to the second fold axis 78, and both of the first 76 and second 78 fold axes may be oriented substantially parallel to the first and second sides of the label structure 20.

The laminating layer 80 overlies the base panel 30 and the first leaflet 40. The laminating layer 80 has front 82 and back 84 faces. The back face 84 of the laminating layer 80 is adhered to a portion of the base panel 30. The back face 84 of the laminating layer is adhered to the first area 36 of the front face 32 of the base panel 30. The back face 84 of the laminating layer 80 is also adhered to a portion of the first leaflet 40, such as a portion of the outer page face 48 of the front first leaf 46 of the first folded panel 42. The back face 84 of the laminating layer 80 has an adhesive 85 applied thereto for adhering the laminating layer to the components of the label structure. In a preferred embodiment of the invention, the adhesive on the laminating layer permits peeling of the laminating layer from and re-adhering of the laminating layer to the base panel to allow re-securing of the leaflets against the base panel by the laminating layer after viewing of the pages faces of the leaflets. The laminating layer 80 may be substantially transparent for permitting viewing of the surfaces to which the laminating layer is adhered.

Significantly, the second leaflet 60 is positioned inside of the first leaflet 40 such that the second leaflet is nested in the first leaflet and the outer page faces 68, 72 of the second leaflet are oriented toward the inner page faces 47, 51of the first leaflet. Preferably, the second fold 64 of the second leaflet is positioned adjacent to the first fold 44 of the first leaflet.

An assembling adhesive 54 adheres the second leaflet to the first leaflet so that the second leaflet is secured to the first leaflet and thus resists loss of the second leaflet from the label structure when the first leaflet is opening up. Preferably, the assembling adhesive 54 is positioned between the first fold of the first leaflet and the second fold of the second leaflet. The assembling adhesive may extend along a bonding line that is oriented substantially parallel to the first fold of the first leaflet. The assembling adhesive may be applied in a substantially continuous strip that extends along substantially the entire length of the fold. Optionally, and less preferably, the adhesive may adhere a portion of at least one of the inner page faces of the first leaflet to a portion of at least one of the outer page faces of the second leaflet, which may hamper viewing of some areas of the page faces, a problem which is generally avoided by applying the adhesive as close as possible to the first fold.

In the preferred embodiment of the invention, no adhesive is applied between the first leaflet and the base panel so that each of the inner and outer page faces of the first and second leaflets are viewable for permitting viewing of indicia marked thereon, and indicia marked on the first area of the front face of the base panel is also viewable by pivoting the first and second leaflets away from the base panel.

It should be noted that additional leaflets may be incorporated into the label structure of the invention by sequential nesting of the additional leaflets inside of the first and second leaflets, with additional assembling adhesive applied between each pair of adjacent leaflets.

The label structure of the invention thus permits the incorporation of multiple leaflet panels into the label without requiring additional production steps for securing the leaflet panels together, such as stapling or trimming, that are often employed to hold nested leaflet panels together. All faces of the pages of the leaflets are viewable and therefore are available for carrying indicia, thereby maximizing the information that may be marked on the label.

Assembly of the label structure may preferably be performed by a label structure forming apparatus in which a plurality of webs (such as, for example, a base panel web, a first leaflet web, a second leaflet web, and a laminating layer web) are brought together in a single continuous process. One such apparatus suitable for assembling the label structure of the invention is disclosed in my copending Application No. filed on and entitled "LABEL STRUCTURE AND METHOD OF FORMING THE LABEL STRUCTURE", which is incorporated herein by reference in its entirety, by modifying such an apparatus to nest multiple leaflets rather than stack multiple leaflets.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A label structure having a first axis with first and second sides extending substantially parallel to the first axis, the label structure comprising:

a base panel having front and back faces, the back face of the base panel having an adhesive applied thereon for affixing the base panel to a surface;

a first leaflet being positioned adjacent to the front face of the base panel, the first leaflet comprising a first folded panel having a first fold, the first fold extending substantially parallel to the first axis of the label structure, the first fold dividing the first folded panel into a pair of first leaves, each of the first leaves having an inner page face and an outer page face;

a second leaflet comprising a second folded panel having a second fold, the second fold extending substantially parallel to the first axis of the label structure, the second fold dividing the second folded panel into a pair of second leaves, each of the second leaves having an inner page face and an outer page face; and a laminating layer overlying the base panel and the first leaflet;

wherein the second leaflet is positioned inside of the first leaflet such that the second leaflet is nested in the first leaflet and the outer page faces of the second leaflet are oriented toward the inner page faces of the first leaflet, an assembling adhesive adhering the second leaflet to the first leaflet.

2. The label structure of claim 1 wherein the second fold of the second leaflet is positioned adjacent to the first fold of the first leaflet.

3. The label structure of claim 1 wherein the assembling adhesive extends along a bonding line oriented substantially parallel to the first fold of the first leaflet.

4. The label structure of claim 1 wherein the assembling adhesive is positioned between the first fold of the first leaflet and the second fold of the second leaflet.

5. The label structure of claim 1 wherein each of the inner and outer page faces of the first and second leaflets are viewable for permitting viewing of indicia marked thereon.

6. The label structure of claim 1 wherein the front face of the base panel has first and second areas, the first leaflet being positioned adjacent to the first area of the front face, indicia being marked on the first area of the front face of the base panel, said indicia being viewable by pivoting the first and second leaflets away from the base panel.

7. The label structure of claim 1 wherein the base panel is substantially opaque and the laminating layer is substantially transparent.

8. A label structure having a first axis with first and second sides extending substantially parallel to the first axis, the label structure comprising:

a base panel having front and back faces, the back face of the base panel having an adhesive applied thereon for affixing the base panel to a surface;

a first leaflet being positioned adjacent to the front face of the base panel, the first leaflet comprising a first folded panel having a first fold, the first fold extending substantially parallel to the first axis of the label structure, the first fold dividing the first folded panel into a pair of first leaves, each of the first leaves having an inner page face and an outer page face;

a second leaflet comprising a second folded panel having a second fold, the second fold extending substantially parallel to the first axis of the label structure, the second fold dividing the second folded panel into a pair of second leaves, each of the second leaves having an inner page face and an outer page face; and a laminating layer overlying the base panel and the first leaflet;

wherein the second leaflet is positioned inside of the first leaflet such that the second leaflet is nested in the first leaflet and the outer page faces of the second leaflet are oriented toward the inner page faces of the first leaflet, an assembling adhesive adhering the second leaflet to the first leaflet;

wherein the second fold of the second leaflet is positioned adjacent to the first fold of the first leaflet;

wherein the assembling adhesive is positioned between the first fold of the first leaflet and the second fold of the second leaflet;

wherein the assembling adhesive extends along a bonding line oriented substantially parallel to the first fold of the first leaflet;

wherein each of the inner and outer page faces of the first and second leaflets are viewable for permitting viewing of indicia marked thereon; and wherein the front face of the base panel has first and second areas, the first leaflet being positioned adjacent to the first area of the front face, indicia being marked on the first area of the front face of the base panel, said indicia being viewable by pivoting the first and second leaflets away from the base panel.

9. The label structure of claim 8 wherein the base panel is substantially opaque and the laminating layer is substantially transparent.

10. A label structure having a first axis and first and second sides extending substantially parallel to the first axis, the label structure comprising:

a base panel for affixing to a surface, the base panel having front and back faces, the back face of the base panel having an adhesive applied thereon for releasably affixing the base panel on the release surface of the liner, the adhesive on the back face of the base panel being removably adhered to the release surface of the liner, the adhesive on the back face of the base panel comprising a pressure sensitive adhesive, the base panel being substantially opaque, the front face of the base panel having first and second areas, indicia being marked on the first area of the front face of the base panel, indicia being marked on the second area of the front face of the base panel;

a first leaflet being positioned adjacent to the front face of the base panel, the first leaflet being positioned against the front face of the base panel, the first leaflet comprising a first folded panel, the first folded panel having a first fold, the first fold extending substantially parallel to the first axis of the label structure, the first fold dividing the first folded panel into a pair of first leaves, each of the first leaves having an inner page face and an outer page face, the inner page faces of the first leaves being oriented inwardly toward each other and the outer page faces of the first leaves being oriented outwardly away from each other, the pair of first leaves comprising a front first leaf and a back first leaf, the outer page face of the back first leaf being oriented toward the front face of the base panel, the outer page face of the back first leaf being positioned adjacent to the front face of the base panel, the outer page face of the back first leaf being positioned adjacent to the second area of the front face of the base panel, each of the inner and outer page faces of the front first leaf and the back first leaf being adapted for permitting viewing of indicia marked thereon;

a second leaflet being positioned inside of the first leaflet such that the second leaflet is nested in the first leaflet, the second leaflet comprising a second folded panel, the second folded panel having a second fold, the second fold extending substantially parallel to the first axis of the label structure, the second fold dividing the second folded panel into a pair of second leaves, each of the second leaves having an inner page face and an outer page face, the inner page faces of the second leaves being oriented inwardly toward each other and the outer page faces of the second leaves being oriented outwardly away from each other, the pair of second leaves comprising a front second leaf and a back second leaf;

wherein the outer page faces of the second leaflet are oriented toward the inner page faces of the first leaflet, and the second fold of the second leaflet is positioned adjacent to the first fold of the first leaflet;

an assembling adhesive adhering the second leaflet to the first leaflet, wherein the assembling adhesive is positioned between the first fold of the first leaflet and the second fold of the second leaflet, the adhesive extending along a bonding line oriented substantially parallel to the first fold of the first leaflet;

a laminating layer overlying the base panel, the first leaflet, and the second leaflet, the laminating layer having front and back faces, the back face of the laminating layer being adhered to a portion of the base panel, the back face of the laminating layer being adhered to the first area of the front face of the base panel, the back face of the laminating layer being adhered to a portion of the first leaflet, the laminating layer being adhered to the outer page face of the front first leaf of the first folded panel, the back face of the laminating layer having an adhesive applied thereto, the laminating layer being substantially transparent.

* * * * *